United States Patent [19]

Dunphy et al.

[11] Patent Number: 4,512,166

[45] Date of Patent: Apr. 23, 1985

[54] CYLINDER LOCK AND KEY

[75] Inventors: Gerald F. Dunphy; Donald J. Newman, both of Melbourne, Australia

[73] Assignee: Ogden Industries Pty. Ltd., Huntingdale, Australia

[21] Appl. No.: 401,417

[22] Filed: Jul. 23, 1982

[30] Foreign Application Priority Data

Jul. 29, 1981 [AU] Australia ..... PE9982

[51] Int. Cl.[3] ..... E05B 15/14; E05B 19/02; E05B 29/02

[52] U.S. Cl. ..... 70/366; 70/377; 70/369; 70/407

[58] Field of Search ..... 70/366, 365, 367, 369, 70/403, 402, 409, 376, 377, 407

[56] References Cited

U.S. PATENT DOCUMENTS 1,589,256 6/1926 Spruth ..... 70/366
3,771,340 11/1973 Krakstrom ..... 70/409

FOREIGN PATENT DOCUMENTS 1417054 12/1975 United Kingdom .
1434386 5/1976 United Kingdom .
2061386 5/1981 United Kingdom .

*Primary Examiner*—Robert L. Wolfe

*Attorney, Agent, or Firm*—Berman, Aisenberg & Platt

[57] ABSTRACT

A lock of the cylinder type having a plurality of discs forming part of the barrel assembly and being rotatable relative to one another and to the body of the barrel assembly. The rotational axis of each disc is substantially coincident with the rotational axis of the complete barrel assembly and each disc has a keyway forming opening which contains that axis. Locking means such as a side locking bar is operative to hold the barrel assembly against rotation relative to the lock cylinder, but that locking means is responsive to the rotational positioning of the discs to release the barrel assembly for rotation when the discs have a particular rotational position relative to one another. The barrel assembly can be rotated in either direction away from the normally locked condition. A key for use with such a lock has an elongate blade which is of non-circular cross section and is twisted to create a plurality of relatively angularly disposed locating portions which are spaced apart longitudinally of the blade. Each locating portion is adapted to cooperate with a respective disc to hold that disc in the aforementioned particular rotational position. The hand of twist is reversed at least once along the blade length and sloping camming surfaces on the blade promote radial movement of the discs as the blade is moved through the lock keyway.

31 Claims, 41 Drawing Figures

6
40
64
68
69
35
43
58
56
104
178
173
194
180
101
174
176
177
172
102
185
186
138
127
181
188
191
187
179
193
195
184
192
189
182
171
108
111
106
105

CYLINDER LOCK AND KEY

This invention relates to cylinder locks of the kind having a barrel rotatably mounted in an outer housing or cylinder and also having key releasable means which functions to hold the barrel against rotation relative to the cylinder. The invention is further concerned with a key for such locks.

A common lock of the aforementioned kind utilises pin tumblers as the key releasable means and the key usually has bittings along one edge of the blade arranged for co-operative engagement with those pin tumblers. Such locks are not satisfactory because of the relative ease with which they may be picked and also the lack of difficulty in duplicating the key. Another form of lock includes disc or plate tumblers, but that lock is subjected to the same difficulties as the pin tumbler locks.

It is a principle object of the present invention to provide a lock having improved security against picking. It is a further object of the invention to provide a key which is difficult to duplicate.

In accordance with one aspect of the invention, there is provided a key operated cylinder lock including, a housing having a cylindrical bore therein, a barrel assembly rotatably mounted within said bore, a plurality of individual discs forming part of said barrel assembly and being arranged for relative rotation about a common axis, a key receiving opening of non-circular shape formed through each said disc at a location such that said common axis passes therethrough, and locking means operative to prevent rotation of said barrel assembly relative to said housing and being responsive to the rotational positioning of the discs so as to be rendered inoperative when each said disc has a particular rotational position relative to the adjacent said disc.

It is preferred that the rotational axis of the discs is substantially coincident with the axis of rotation of the total barrel assembly and is arranged to pass substantially through the centre of the disc openings. It is also preferred that each disc has a camming face at a front side so as to be cooperable with a key inserted into the lock such that longitudinal movement of the key causes rotation of an engaged disc.

In accordance with another aspect of the invention, there is provided a key usable with a cylinder lock having a plurality of rotatable locking elements and including, an elongate blade adapted for insertion into a keyway of said lock, a plurality of locating portions provided along each said blade and being spaced apart in the longitudinal direction thereof, the cross sectional shape of said blade at each said locating portion being non-circular and having a major axis which extends transverse to and substantially intersects the longitudinal axis of said blade, each said major axis being angularly displaced about said longitudinal axis relative to at least one other said major axis, at least one indexing surface at each said locating portion which determines the rotational position of a said locking element engaged thereby when said blade is fully inserted into said keyway, and at least one camming surface extending between adjacent said locating portions and being arranged to cause partial rotation of an engaged said locking element as said blade is moved longitudinally through said keyway.

The major axis of each locating portion does not necessarily bisect that portion, nor is it necessary for any surface of the locating portion to extend parallel to that axis. The major axis is simply a datum whereby the disposition of one locating portion can be related to another. In a preferred arrangement however, each locating portion has a greater width in the direction of its major axis then transverse thereto, and the indexing surface is substantially parallel to the major axis.

The angular disposition of the major axes gives the key blade a twisted configuration and in a preferred form of the key the hand on that twist reverses at least once along the length of the blade. Because of that twisted configuration, longitudinal movement of the key blade through the lock causes partial rotation of each of the various locking elements. For that purpose it is preferred that there is substantial conformity between the cross sectional shape of the key blade and the openings in the locking elements, but such conformity is not essential.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

In the drawings:

FIG. 7 is a cross sectional view taken along line VII—VII of FIG. 5;

Figure 1:
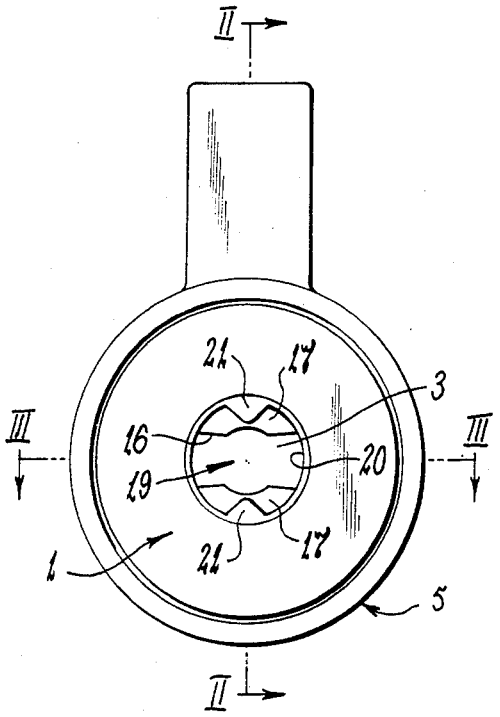
FIG. 1 is a front end view of one form of cylinder lock incorporating one embodiment of the invention.
Figure 6:
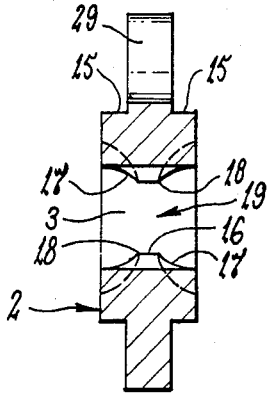
FIG. 6 is a cross sectional view taken along line VI—VI of FIG. 5.

One particular lock according to the invention is shown in FIGS. 1 to 12 and includes, as part of the barrel assembly 1, a plurality of relatively rotatable discs 2 each of which has a non-circular opening 3 formed through a central region thereof. The blade of the key for the lock (which will be hereinafter described) has a transverse cross section which is substantially complementary to the shape of the disc opening 3 and that blade is twisted at least along part of its length so that it has a camming facility as hereinafter described. The discs 2 are arranged to influence operation of locking means 4 which functions to hold the barrel assembly 1 against rotation relative to the cylinder 5 and the locking means 4 is rendered inoperative when each disc 2 has a particular rotational disposition relative to the or each adjacent disc 2. That relationship between the various discs 2 is achieved by insertion of a correctly formed key 6 (FIG. 2) into the keyway formed by the disc openings 3.

The shape of the disc opening 3 can vary to suit requirements, but is preferably substantially the same for each disc 2. In the example shown (see FIGS. 1 and 5) the opening 3 is substantially rectangular and is substantially symmetrical about any plane containing the rotational axis of the disc 2. Such a symmetrical arrangement is convenient for manufacturing purposes, but is not essential to the invention. The preferred opening 3 therefore has a major axis 7 (FIG. 5) which is transverse to the rotational axis of the disc 2 and bisects the opening 3 in the longitudinal direction of the opening 3. It will be convenient to hereinafter describe the rotational disposition of such an opening 3 by reference to its major axis 7. Openings of other shapes, whether they be symmetrical or not, can be regarded as having a major axis for the purpose stated and that axis can be arbitrarily selected, but must be the same for all openings in the same group of discs. The cross sectional shape of the key blade (hereinafter described) will of course have a major axis which corresponds to that of the disc opening 3 with which it is to be used.

Figures 1, 4, 5:
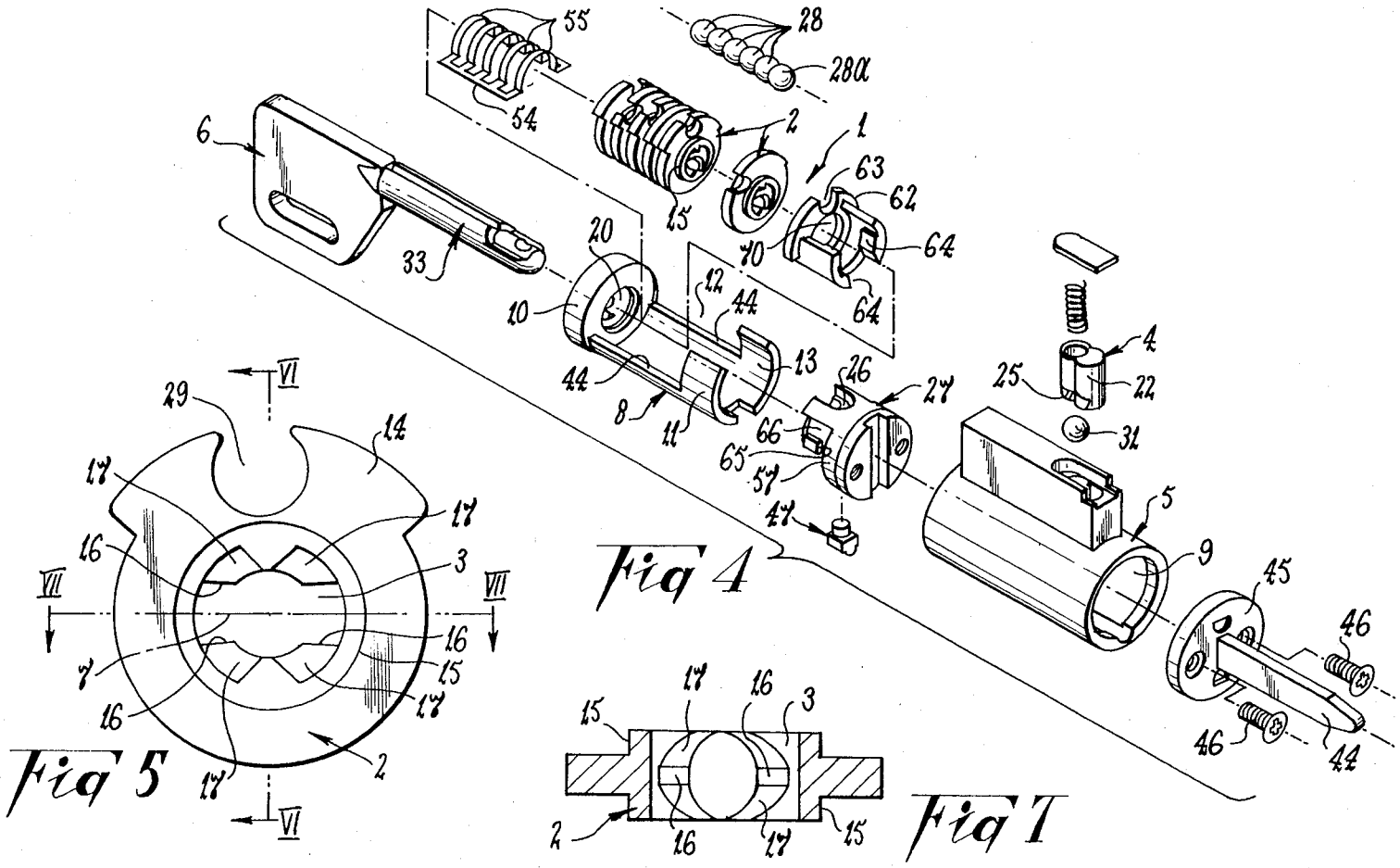
FIG. 4 is an exploded perspective view of the lock shown in FIG. 1 and showing a blank key associated with that lock.
FIG. 5 is an enlarged end view of one of the discs of the lock shown in FIG. 4.

In the particular embodiment of the invention shown in FIGS. 1 to 12, the barrel assembly 1 includes a disc carrier 8 which is generally of cylindrical form as as to be rotatable within the bore 9 of the lock cylinder 5. The carrier 8 includes a front cylindrical section 10 and a tubular section 11 which is coaxial with the front section 10 and extends rearwardly therefrom (FIG. 4). A portion of the tubular section 11 adjacent the front section may have an opening 12 along one side to permit location of the discs 2 within the tubular section 11. For that particular arrangement, a substantial part of the periphery of each disc 2 may have an outer diameter which is substantially the same as the inner diameter or bore 13 of the tubular section 11 and a laterally projecting lobe 14 extends over the remaining part of the periphery as shown in FIG. 5. Each disc 2 may also have an axially extending boss 15 formed on each side and the diameter of the boss 15 is less than the diameter of the tubular section bore 13.

It will be appreciated that the tubular section 11 need not be open sided as described to permit mounting of the discs 2. The discs 2 may be inserted axially into the tubular section 11 in other constructions. Also, the term "disc" is not to be understood as necessarily requiring a small axial depth as compared with diameter. The discs 2 may in fact have a substantial axial depth such as to be more in the form of short cylinders, but it will be convenient to refer to all possible forms as discs.

Any number of discs 2 can be selected to suit particular requirements. In the example shown there are six discs 2 and they are arranged within the tubular section 11 in face to face relationship—i.e., the bosses 15 of adjacent discs 2 are in end to end engagement. For each disc 2, the relationship between the major axis 7 of the opening 3 and the disc lobe 14 may be substantially the same but that is not essential. As shown, the shape of the opening 3 may be circular at the centre—i.e., coaxial with the disc axis—with a slot extending from opposite sides of that central portion. In the result, the opening 3 is generally rectangular in shape. The side surfaces 16 of the slot portions of the opening 3 form key reacting surfaces which function as hereinafter described. Because of the substantial axial depth of the disc 2, it is preferred to provide camming faces 17 at each axial end of the disc opening 3. In the example shown, there may be four camming faces 17 at each end of the disc 2. Each camming face 17 is located immediately adjacent the opening 3 and slopes inwardly from the respective end face of the disc to terminate at a respective one of the key reacting surfaces 16 of the disc opening 3. Thus, each camming face 17 converges inwardly towards a corresponding camming face 17 at the other end of the disc 2 and a narrow land 18 (FIG. 6) is formed between those camming faces 17 and that land forms one of the surfaces 16.

When the group of discs 2 are properly located in the tubular section 11 of the carrier 8 their respective openings 3 are in axial alignment and combine to form a keyway 19 (FIG. 1). Access to the keyway 19 is obtained through an opening 20 in the front section of the carrier 10 and that access opening 20 also has a non-circular shape, but which is different to the shape of the disc openings 3. For example, as shown in FIG. 1, the access opening 20 may be circular save for a "V" shaped protrusion or rib 21 at each of two sides and preferably arranged in diametrically opposed relationship.

The locking means 4 of the arrangement shown in FIGS. 1 to 12, includes a plunger 22 slidably mounted in a wall 23 of the cylinder 5 for movement towards and away from the barrel assembly 1 and which is biased by a spring 24 in the former direction. An inner end portion 25 of the plunger 22 is arranged for location within a locking recess 26 of the barrel assembly 1 such as to hold that assembly 1 against rotation relative to the cylinder 5. The locking recess 26 may be provided in the outer surface of a cylindrical end cap 27 of the barrel assembly 1 which is attached to the inner or rear end portion of the tubular section 11 for rotation with that section as shown.

As previously mentioned, the discs 2 are adapted to control operation of the locking means 4 through their relative rotational disposition, which is in turn controlled by the key 6. In the embodiment under consideration, when the discs 2 of the group have a particular arrangement, they are adapted to influence the locking means 4 through actuator means which is activated only at that particular arrangement of the discs 2.

Figure 2:
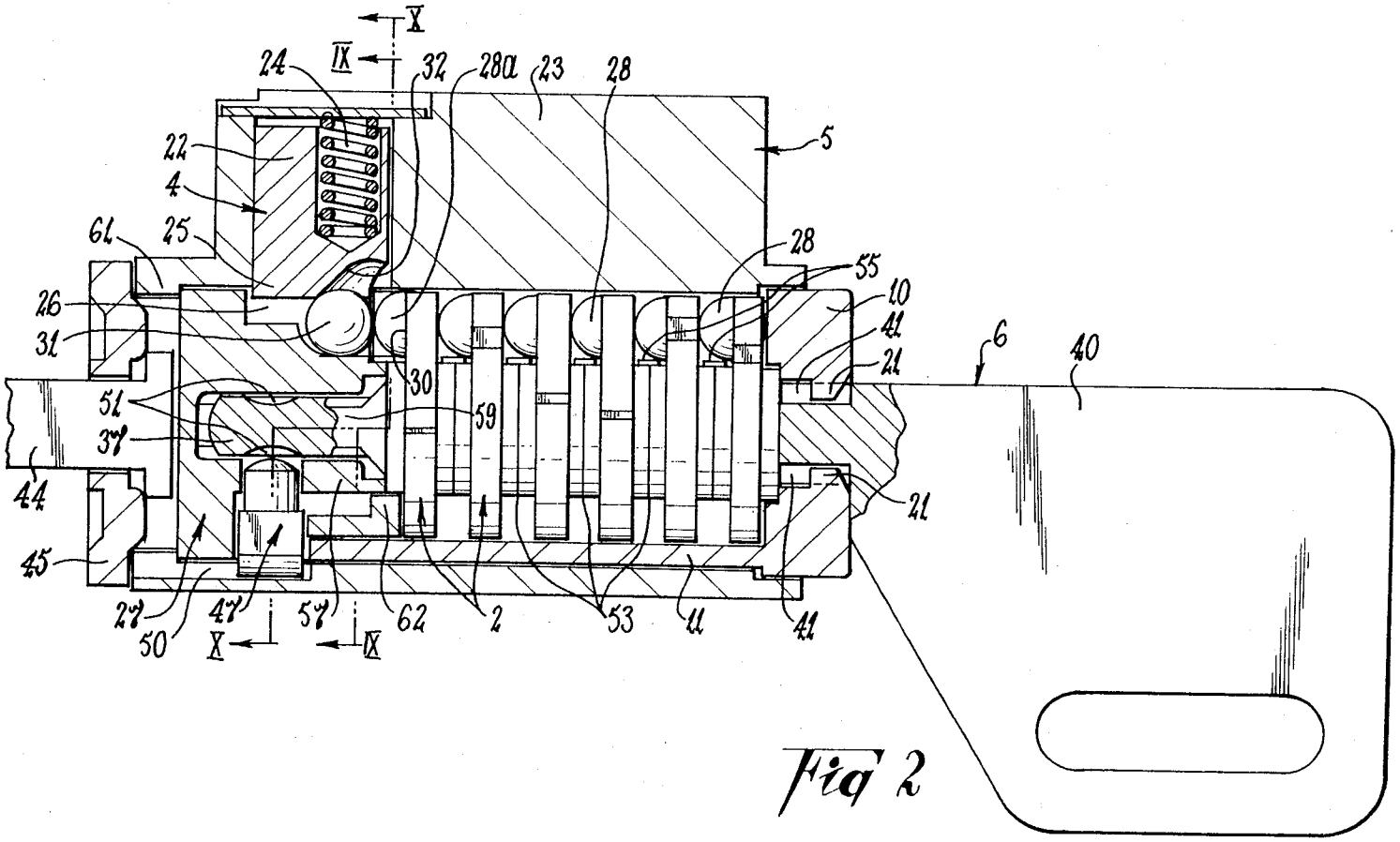
FIG. 2 is an enlarged cross sectional view taken along line II—II of FIG. 1 but showing a key inserted into the lock.
Figure 8:
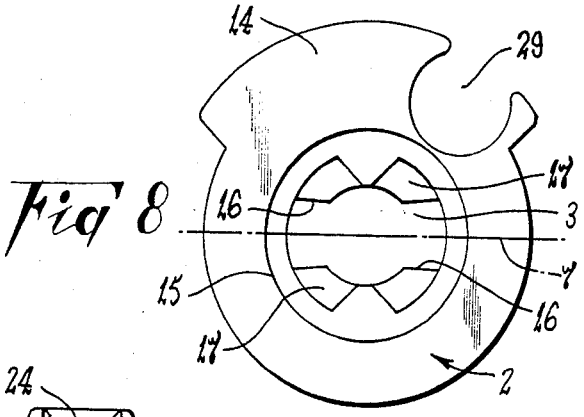
FIG. 8 is a view similar to FIG. 5 but showing another disc of the barrel assembly.
Figure 9:
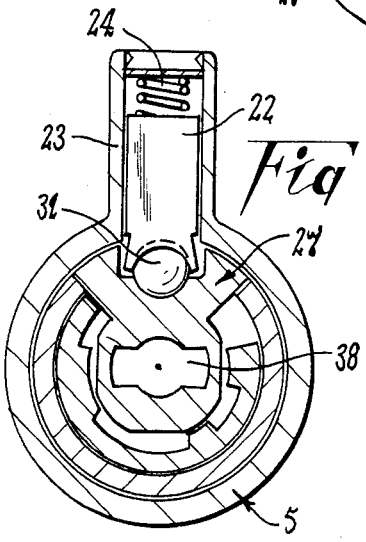
FIG. 9 is a transverse cross sectional view taken along line IX—IX of FIG. 2, but without the key inserted into the lock.

The actuator means of the construction shown, comprises a series of balls 28, each of which is carried by the lobe 14 of a respective disc 2. Each ball 28 has a diameter greater than the axial depth of the lobe 14 and is carried in a circular hole 29 formed through the lobe 14. The relationship between the hole 29 and the major axis 7 of the disc opening 3 is different for at least two of the discs 2 in the group, as shown by FIGS. 5 and 8, but in a preferred arrangement it is different for at least a majority if not all of the discs 2. When the discs 2 are arranged such that the holes 29 are in axial alignment, the actuator balls 28 engage one another and the combined length of those engaging balls 28 is such that the rearmost ball 28*a* protrudes further than it otherwise would beyond the rearmost surface 30 of its respective disc lobe 14 (compare FIGS. 2 and 3). In that condition, which is shown in FIG. 2, the rearmost ball 28*a* causes a lifting element 31 to move the locking plunger 22 out of the locking recess 26.

Figure 3:
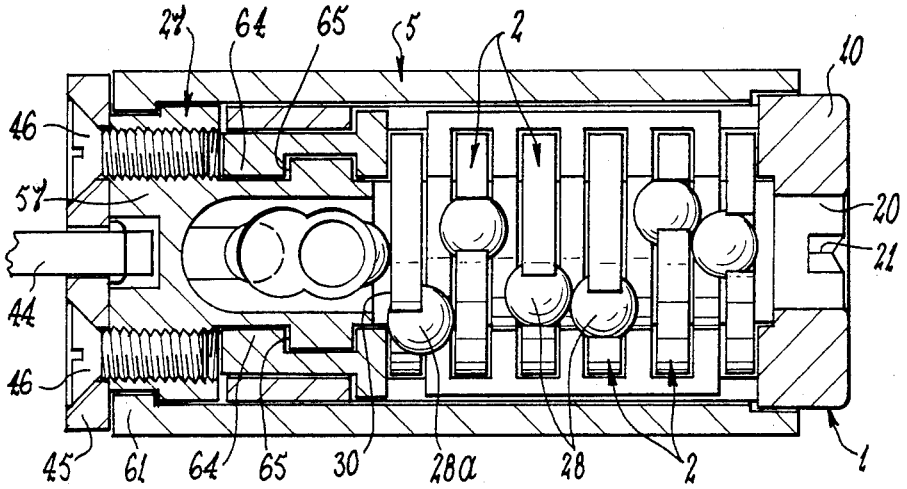
FIG. 3 is an enlarged cross sectional view taken along line III—III of FIG. 1 and which does not show the key inserted into the lock.

In the particular construction shown, the lifting element 31 is also a metal ball which is located in a front end portion of the locking recess 26 and that recess 26 is aligned with the engaging actuator balls 28. The lifting ball 31 is pushed rearwardly by the aligned actuating balls 28 and thereby moves against a ramping surface 32 of the plunger 22 so as to lift the plunger 22 out of the locking recess 26. In the unaligned condition of the actuator balls 28 as shown in FIG. 3, the spring loaded plunger 22 pushes the lifting ball 31 forwardly and is thereby able to enter the locking recess 26.

Figure 13:
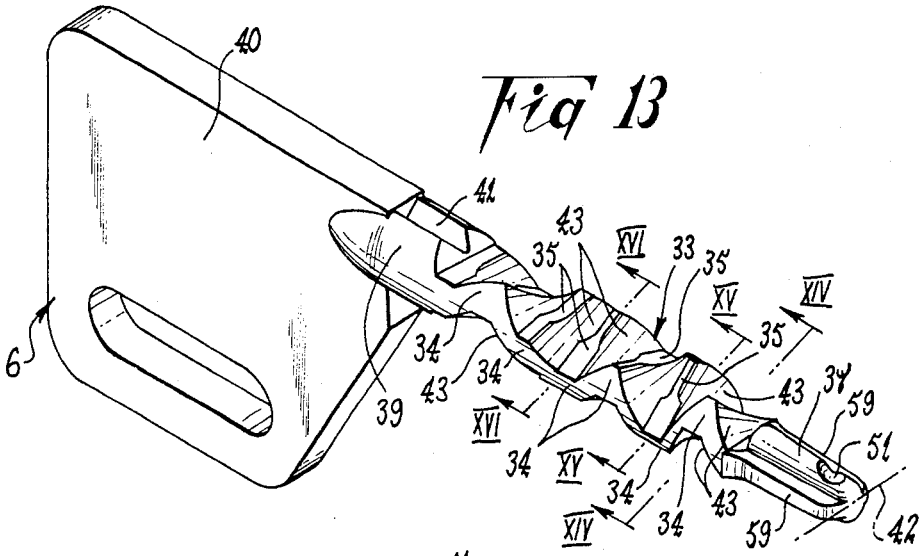
FIG. 13 is a perspective view of one form of key usable with the lock of FIG. 1.

In FIG. 4, the key 6 is shown as a blank for convenience of illustration. That is, the elongated blade 33 has not been "bitted" or formed for cooperative engagement with the discs 2. Indeed, as shown, the blade 33 could not enter the disc openings 3. FIG. 13 shows the bitted blade 33 and as seen from FIGS. 14 to 16, the cross sectional shape of the blade 33 is substantially complementary to the shape of the openings 3, but that is not essential.

Figure 14:
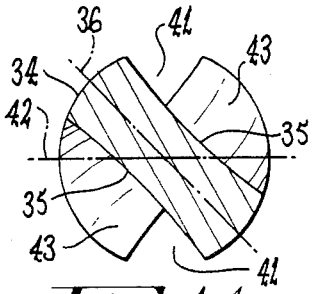
FIGS. 14 to 16 are transverse cross sectional views taken along lines XIV—XIV, XV—XV and XVI—XVI respectively of FIG. 13.
Figure 15:
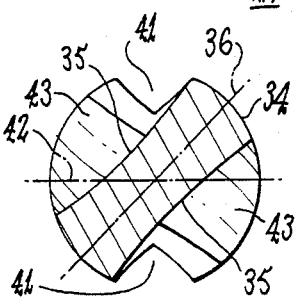
Figure 16:
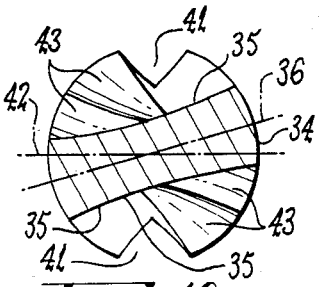

The blade 33 has a plurality of locating portions 34 provided at spaced intervals along its length. Each of the sections forming FIGS. 14 to 16 is taken at a respective locating portion 34 of the blade 33. Although the sectional shape of the blade 33 at the locating portions 34 is not strictly in conformity with the disc openings 3, that section shape is such that a disc 2 positioned at a locating portion 34 is held against rotation relative to the key blade 33. In particular, at each locating portion 34, the key blade 33 has two oppositely facing indexing surfaces 35 which fit neatly between the opposed key reacting surfaces 16 of the disc opening 3.

At each locating portion 34, the cross section of the key blade 33 has a major axes 36 which extends transverse to and intersects the longitudinal axis of the blade 33. In the example of FIGS. 14 to 16, the major axes 36 bisects the blade cross section, but that is not essential.

The key blade 33 is twisted along at least part of its length as a result of angular displacement of the major axes 36 of the blade cross-section as shown in FIGS. 14 to 16. The consequence of that twisted configuration will become apparent from the following description. It is preferred that the terminal end portion 37 of the blade 33 has a cross-sectional shape to fit into a correspondingly shaped recess or passage 38 (FIG. 9) in the barrel end cap 27 so as to prevent relative rotation between the key 6 and the barrel assembly 1. In the form shown in FIG. 13, the key terminal end portion 37 has a cross-sectional shape not significantly different to the shape of the disc openings 3. The opposite end portion 39 of the blade 33 adjacent to the key head 40 preferably has a cross-sectional shape substantially corresponding to that of the keyway access opening 20 and therefore also functions to prevent relative rotation between the key 6 and the barrel assembly 1. For that purpose the blade portion 39 has a pair of grooves 41 for receiving the ribs 21 of the access opening 20.

In the preferred arrangement shown, the twisted section of the key blade 33 extends over most if not all of the blade length between the two end portions 37 and 39. The twist may be relatively sharp or gradual according to requirements and in the preferred arrangement shown the direction of twist is reversed at one or more locations, which generally coincide with respective locating portions 34. The degree of twist may be selected to suit requirements—for example, it may be up to or more than 55° either side of the major axis 42 of the blade section at the end portion 37. In one arrangement however, the degree of twist is approximately 15° on each side of the major axis 42 so that the maximum variation in angular disposition of the major axes 36 at the locating portions 34 is approximately 30°.

The twist reversal, whenever it occurs, may be gradual or sharp to suit requirements. The twist need not be reversed however, but could be of the same hand along the length of the blade 33. In that event, the degree of twist may vary along the length of the blade 33.

A sloping camming surface 43 extends between each two adjacent indexing surfaces 35 and each such surface 43 is arranged substantially transverse to the longitudinal axis of the blade 33 and slopes generally in the longitudinal direction of the blade 33. When such a key blade 33 is being moved through the keyway 19, the camming surfaces 35 of the blade 33 cooperate with the disc camming faces 17 to promote rotation of the discs 2.

Prior to insertion of the key blade 33 into the keyway 19, the discs 2 will generally be in a scrambled condition such that the major axes 7 of their respective openings 3 are angularly disposed relative to one another. In the lock of FIG. 4, the width of the barrel assembly opening 12 limits the extent of relative angular disposition of the disc openings 3 because rotation of the discs 2 relative to the tubular section 11 is limited by the lobes 14 engaging the longitudinal edges 44 of the opening 12. It is of course possible that in spite of the unbiased or freely rotatable nature of the discs 2 that they will not be scrambled before the key blade 33 is inserted, but that does not affect the operation described below.

Because of the twisted configuration of the blade 33 it cannot be moved longitudinally through the keyway 19 unless the discs 2 rotate to continually align their respective openings 3 with an adjacent portion of the blade 33. It is preferred to achieve that alignment without requiring rotation of the blade 33 relative to the barrel assembly 1, and in any event the facility for such relative rotation may be severely limited. Cooperative engagement between the camming surfaces 43 of the blade 33 and the camming faces 17 of the discs 2 enables the necessary rotation of the discs 2 to be achieved with minimum longitudinal force applied to the key 6. The camming surfaces 43 also cooperate with the periphery of the disc openings 3 to cause the necessary disc rotation.

Whenever the hand of twist of the key blade 33 reverses, the direction of slope of the adjacent camming surfaces 43 will also reverse as will be apparent from FIG. 13. It will also be apparent from FIG. 13 that the hand of twist can be the same on each side of a particular indexing surface 35.

Figure 17:
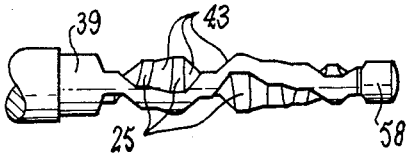
FIG. 17 is a side elevation view of a key blade similar to that shown in FIG. 13.
Figure 19:
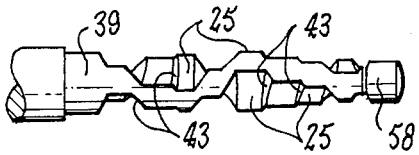
FIG. 19 is a view similar to FIG. 17 but showing a slightly different form of key blade.
Figure 20:
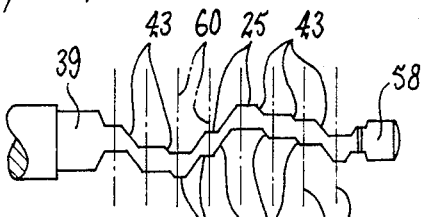
FIG. 20 is a diagrammatic development of the key blade of FIG. 19.

It will be appreciated that a key 6 as described would be difficult to duplicate and lends itself to a large number of key changes so as to be useful in a lock system having a substantial range of combinations. FIGS. 17 to 20 show two possible arrangements of the key blade 33 which illustrate the possible range of variations. In FIG. 17 the key blade 33 is arranged so that longitudinal spacing between adjacent indexing surfaces 35 remains substantially constant, but the angle of slope of the camming surfaces 43 varies. That arrangement is more clearly seen in FIG. 18 which is a development of the blade configuration shown in FIG. 17. FIGS. 19 and 20 are similarly related figures showing a key blade 33 having consistent spacing of the indexing surfaces 35 and a consistent angle of slope of the camming surfaces 43. As best seen in FIG. 13, the camming surfaces 43 actually follow a helical path so the expression "angle of slope" is used rather loosely and should be read accordingly in all passages of this specification.

Figure 18:
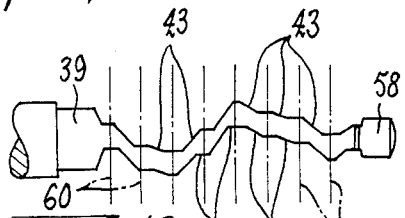
FIG. 18 is a diagrammatic development of the key blade of FIG. 17.

In both FIGS. 18 and 20, the line 60 represents the longitudinal spacing between the indexing surfaces 35 and each line 60 is substantially at the centre of the respective surface 35. Each surface 35 has a width in the longitudinal direction of the blade 33 which varies because of the helical nature of the adjacent camming surfaces 43. The longitudinal spacing represented by line 60 need not be consistent as described, but could vary along the length of the blade 33.

The blade arrangement of FIGS. 19 and 20 has the advantage that, during withdrawal of the blade 33 from the keyway 19, not all discs 2 are rotating at the one time because of the irregular longitudinal displacement of the camming surfaces 43. Such an arrangement reduces the effort necessary to withdraw the key 6 from the lock.

The twisted configuration of the key blade 33 is not necessarily achieved through physical "twisting" of that blade 33—it may be achieved by machining, grinding or any other suitable process. The twisted configuration of the key blade 33 establishes the combination of the corresponding lock as previously described so there will be variations in that configuration between keys 6 intended for different locks. As the key blade 33 is inserted into the keyway 19 of the corresponding lock as shown in FIGS. 1 to 12, the cam surfaces 43 of the blade 33 will contact the disc cam faces 17 with the result that the discs 2 will rotate in response to axial movement of the blade 33 through the keyway 19. With a reverse twisted blade 33 as described, the discs 2 will be caused to oscillate by their interaction with the various parts of the blade 33. The configuration of the blade 33 is predetermined according to the relationship between the major axis 7 and hole 29 of each disc 2 so that in the fully inserted position of the key 6 the disc lobe holes 29 are aligned as previously described (FIG. 2). When the blade 33 is withdrawn however, the discs 2 are again oscillated so that the lobe holes 29 are "scrambled" in location.

Figure 12:
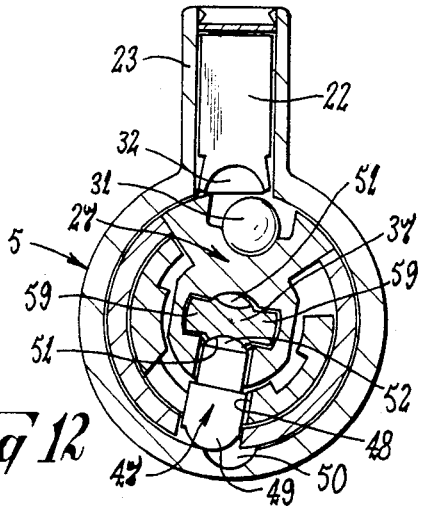
FIG. 12 is a view similar to FIG. 10 and showing the key fully inserted into the lock and turned partially to rotate the barrel assembly relative to the cylinder.

In the fully inserted position of the key blade 33, the barrel assembly 1 is freed from the constraining influence of the locking plunger 22 (FIG. 11) and consequently the key 6 can be turned in either direction to rotate the barrel assembly 1 (FIG. 12). That assembly 1 can be operatively connected to a latch, deadbolt or other mechanism (not shown), by any appropriate means. For example, as shown in FIG. 4, a flat metal bar connector 44 may be provided so as to co-operate with the associated mechanism in a known manner. That connector or drive bar 44 may be attached to the rear end of the barrel assembly end cap 27 as shown—for example, through a mounting plate 45 which is attached to the end cap 27 by screws 46 or other fastening means.

Figure 10:
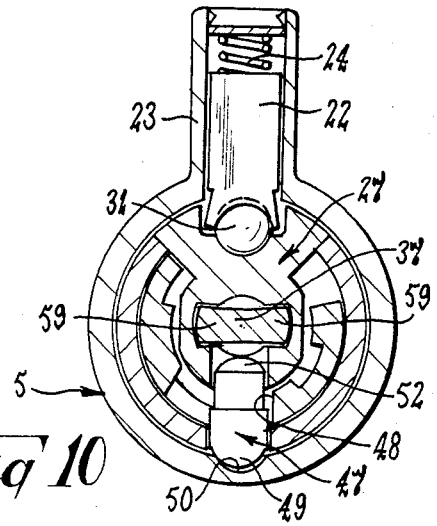
FIG. 10 is a cross sectional view taken along line X—X of FIG. 2 and showing the key partially inserted into the lock.
Figure 11:
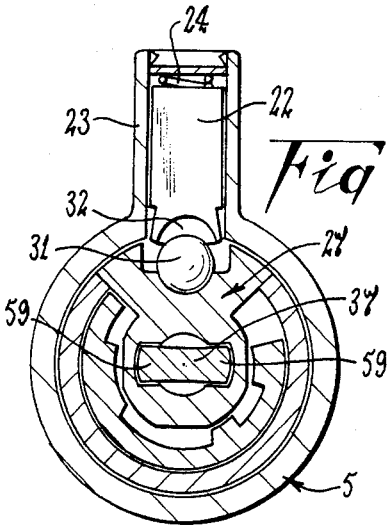
FIG. 11 is a view similar to FIG. 9 and showing the key fully inserted into the lock.

Means may be provided to prevent withdrawal of the key 6 from the keyway 19 unless the barrel assembly 1 has a particular rotational position relative to the cylinder 5. In the construction of FIGS. 1 to 12, that means includes a detent pin 47 which is slidably mounted in a radial bore 48 of the end cap 27. An outer end portion 49 of the pin 47 is locatable in a groove or recess 50 provided in the adjacent wall of the cylinder 5 as shown in FIGS. 10, and at that position of the pin 47 it remains clear of the passage 38 (FIG. 9) in the end cap 27 which receives the terminal end portion 37 of the key blade 33. When the key blade 33 is fully inserted into the keyway 19, a recess 51 (FIG. 13) in that terminal end portion 37 is aligned with the pin 47 and the inner end portion 52 of the pin 47 enters that recess 51 as the pin 47 is cammed out of the cylinder groove 50 by initial rotation of the barrel assembly 8 (FIG. 12). The pin 47 remains in that key recess 51 and thereby prevents withdrawal of the key 6, until the barrel assembly 1 is returned to the initial position at which the pin end portion 49 is able to enter the cylinder groove 50 (FIG. 10).

It may be desirable to also provide means for inhibiting picking of the lock. In the form shown in FIG. 4, such anti-picking means includes a shield over the separation line 53 (FIG. 2) between each disc 2 on the open side of the tubular section 11 of the barrel assembly 1. As shown, a single element 54 may provide all of the shields and is preferably in the form of a plate-like member having curved bar sections 55 which constitute individual shields.

Figures 21, 22:
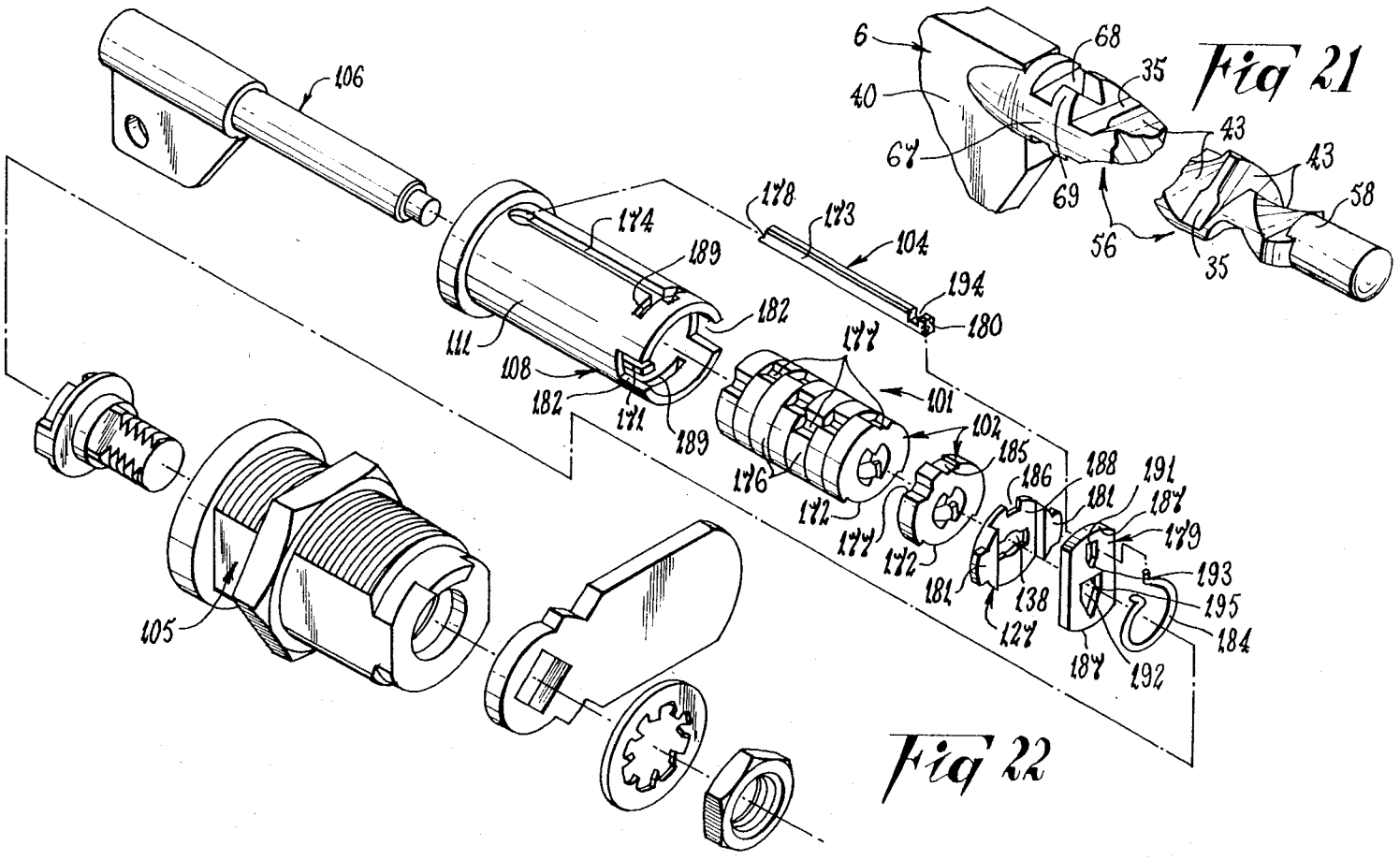
FIG. 21 is a perspective view of portions only of the key blade of a special key for use with the lock of FIG. 1.
FIG. 22 is an exploded perspective view of another form of lock incorporating an embodiment of the invention and again showing a blank key associated with that lock.

Provision might also be made to enable alteration of the combination of the lock. For that purpose, the barrel assembly 1 or part thereof may be arranged for removal from the cylinder 5 by use of a special key which may be identical to the standard key 6 save for an alteration to the blade end portions 37 and 39 as hereinafter discussed in relation to FIG. 21 which shows end parts of the blade 56 of the special key. In the arrangement shown, the special key blade 56 is arranged for limited rotation relative to a part 57 of the end cap 27 of the barrel assembly 1 when fully inserted into the keyway 19. For that purpose, the terminal end portion 58 of the key blade 56 is substantially cylindrical as shown in FIG. 21. In particular, that end portion 58 does not have ribs 59 on two opposite sides as does the end portion 37 of the standard blade 33. The arrangement is such that, in the fully inserted condition of the special key blade 56, the end portion 58 is rotatably located within the passage 38 of the end cap 27. Otherwise, the special key blade 56 functions to align the actuator balls 28 in the usual manner.

The end portion 67 of the special key blade 56 shown in FIG. 21 corresponds to the end portion 39 of the standard key blade 33. The end portion 67 differs from the end portion 39 in the provision of two transverse slots 68 each of which is able to receive a respective one of the ribs 21 of the keyway axis opening 20 as hereinafter described.

Axial separation of the barrel assembly 1 and cylinder 5 is normally prevented by the connection of the barrel assembly end cap 27 and the mounting plate 45 of the drive bar 44. That is, the end cap 27 and mounting plate 45 are located on opposite sides respectively of an internal circumferential rib 61 of the cylinder 5 as shown in FIGS. 2 and 3. Also in the construction shown, the end cap 27 is formed of two parts 57 and 62. The cap part 57 is secured to the mounting plate 45 and the other part 62 is located adjacent to the discs 2 and includes a peripheral opening 63 through which the rearmost actuator ball **28*a* projects to engage the plunger lifting ball 31. The cap part 62 is arranged for limited rotation relative to the other or fixed part 57 and such relative rotation in either direction from the normal position enables it to be separated axially from the fixed part 57. That may be achieved, as shown, by providing the movable part 62 with internal retention lugs 64 which normally locate behind and abut rearwardly facing shoulders 65 of the fixed part (FIGS. 3 and 4), but which are aligned with longitudinal grooves 66 in the fixed part 57 when the movable part 62 is rotated relative to the fixed part 57**.

The end portion 58 of the special key blade 56 also differs from the corresponding portion 37 of the standard blade 33 in that the recesses 51 are omitted. Thus, in the fully inserted condition of the key blade 56 the end portion 58 serves to hold the pin 47 in the position shown in FIG. 10 at which the pin 47 serves to hold the cap part 57 against rotation relative to the cylinder 5.

Thus, when the special key blade 56 has been fully inserted into the keyway 19 and is turned through an appropriate angle, the movable part 62 of the end cap 27 will be turned relative to the fixed part 57 to adopt the release position. In that regard, the ball **28*a* is located in both the opening 63 of the cap part 62 and the hole 29 of the adjacent disc 2 when the blade 56 is fully inserted into the lock so the situation is the same as if a standard key 6 was used and as shown in FIG. 2. The end portion 58 of the blade 56 however, turns freely within the passage 38 of the cap part 57 so that part 57 remains unaffected as the blade 56 is rotated about its longitudinal axis. As that rotation commences, the relatively short ribs 21 in the keyway access opening 20 move into the transverse slots 68 of the special key blade 56 to locate behind the sections 69 of that blade. Continued turning movement of the key blade 56 moves the cap part 62 to a position at which the lugs 64 are aligned with the grooves 66 (FIG. 4) so that longitudinal outward movement of the key blade 56 then causes the barrel assembly 1 to be removed from the cylinder 5, with the exception however of the fixed part 57 of the end cap 27. Relocation of the barrel assembly 1** or an exchange assembly is achieved by the reverse procedure.

The standard key 6 cannot cause axial withdrawal of the barrel assembly 1 because of its inability to rotate relative to the disc carrier 8 of the barrel assembly 1 and the fixed part 57 of the end cap 27. In that regard, the passage 70 (FIG. 4) through the movable part of the end cap 27 does not contain any portion with which the terminal end portion 37 or 58 of either key blade 33 or 56 cooperates.

It is possible to master-key a lock as described and for that purpose one or more of the discs 2 may carry two or more actuator balls 28 at circumferentially spaced locations.

The basic concept of the invention may be embodied in a variety of constructions quite different to that particularly described. In an example variation, the discs of the barrel assembly may be arranged for direct influence on the locking means rather than through the intermediary of actuator means as previously described. Such a variation is shown in FIGS. 22 to 30 of the drawings and components of that construction which correspond to components of the previously described construction will be given like reference numerals except that they will be in the number series 100 to 199.

In this further embodiment of the invention as shown, the tubular section 111 of the barrel assembly 101 is not open sided as previously described, and the discs 102 are loaded axially into that section 11. Furthermore, in the embodiment of FIGS. 1 to 21 the laterally projecting lobes 14 of the discs 2 serve to limit the extent to which the discs 2 can rotate relative to the tubular section 111. In the FIGS. 22 to 30 embodiment the discs 102 do not have such lobes and relative rotation is limited by a longitudinal rib 171 on the internal surface of the tubular section 111 and which locates within a peripheral recess 172 of each disc 102. Each recess 172 is of a size sufficient to allow the necessary rotational movement of the disc 102.

Figure 23:
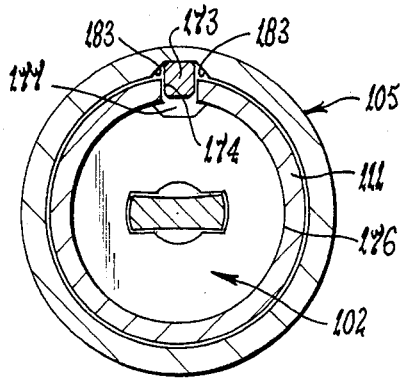
FIG. 23 is an enlarged transverse cross sectional view of the lock assembly of FIG. 22 showing a key inserted into the lock to place it in a barrel release condition.
Figure 24:
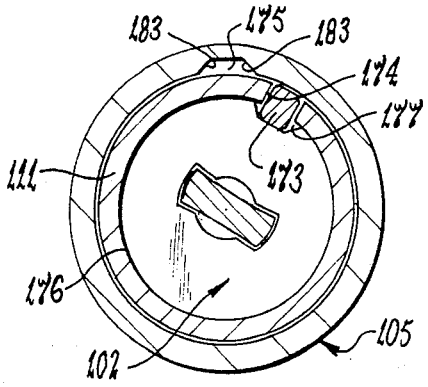
FIG. 24 is a view similar to FIG. 23 but showing the barrel assembly rotated relative to the cylinder.
Figure 25:
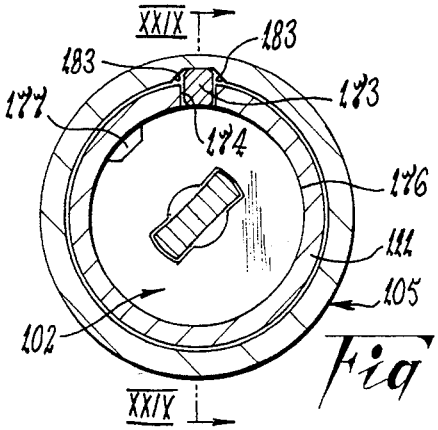
FIG. 25 is a view similar to FIG. 24 but showing the condition of the lock during withdrawal of the key.
Figure 27:
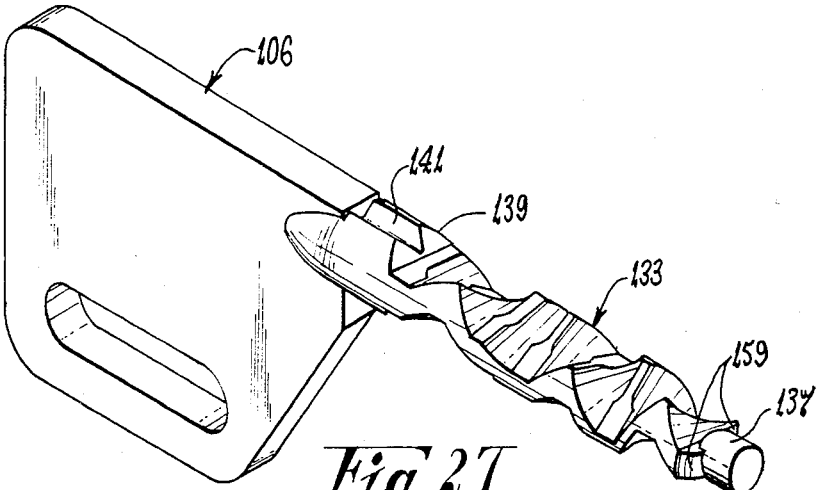
FIG. 27 is a perspective view of a standard key suitable for use with the lock of FIG. 22.
Figure 26:
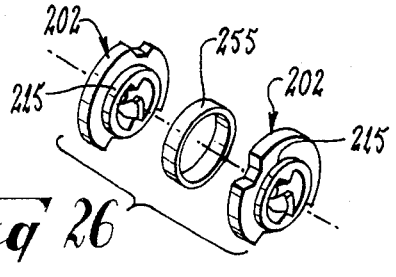
FIG. 26 is an exploded perspective view of an alternative form of disc arrangement for the lock shown in FIG. 22.

The locking means 104 comprises a side locking bar 173 which extends generally in the longitudinal direction of the barrel assembly 101 and is located in a longitudinal slot 174 formed through the wall of the tubular section 111. The bar 173 is movable radially of the barrel assembly 101 between lock and release positions (FIGS. 25 and 24 respectively) in which the barrel assembly 101 is prevented and allowed respectively to rotate relative to the cylinder 105. In the lock position (FIG. 25) the bar 173 engages within a locking groove 175 formed in the internal surface of the cylinder 105 and which extends longitudinally thereof. The bar 173 is held in that lock position by engagement with the peripheral surfaces 176 of the discs 102 as shown in FIG. 25, but each disc 102 has a bar receiving cavity 177 formed in its periphery and when those cavities 177 are aligned as shown in FIG. 23 the bar 173 is able to move clear of the locking groove 175 and thereby permit rotation of the barrel assembly 101. Alignment of the cavities 177 is achieved by insertion of a correct key 106 as previously described and FIG. 27 shows a key 106 for that purpose. In that regard, FIG. 22 shows a blank or uncut key 106.

It will be apparent that a plurality of circumferentially spaced locking bars 173 could be used in the above described construction, but it will be convenient to hereinafter refer to one bar only.

The side locking bar 173 may be spring influenced towards its outer locked position (FIG. 23) and any appropriate means may be employed to hold it against separation from the barrel assembly 1. By way of example, a retainer ring (not shown) may hold the front end 178 of the bar 173 against complete separation from the tubular section 111 and a retainer plate 179 may hold the opposite end 180. In the FIG. 22 construction, the retainer plate 179 is carried by an end cap 127 of the barrel assembly 101. The end cap 127 has a pair of oppositely disposed lugs 181 which locate within respective recesses 182 of the tubular section 111 to hold the cap 127 against rotation relative to that section 111. Other arrangements could be adopted for the same purpose.

When the disc cavities 177 are aligned beneath the locking bar 173 as shown in FIG. 23, rotation of the barrel assembly 1 results in the bar 173 being cammed out of the locking groove 175 and into the aligned cavities 177. Such camming action may be achieved by sloping side surfaces 183 (FIG. 24) of the locking groove 175 and the longitudinal edges of the locking bar 173 may be chamfered to assist in that regard. A biasing spring 184 (FIG. 22) serves to return the bar 173 to the lock position when relocated beneath the locking groove 175 in a manner hereinafter described.

Anti-picking means for this embodiment may include at least one anti-picking recess 185 (FIG. 22) provided in the peripheral surface 126 of at least one of the discs 102. In an alternative arrangement shown in FIG. 26, the discs 202 have an axially extending boss 215 on each side as in the embodiment of FIGS. 1 to 12. An anti-picking sleeve 255 is located between each two adjacent discs 202 to surround the adjacent bosses 215 and thereby extend over the separation line between the discs 202.

The barrel assembly 101 may be removable as described in relation to the embodiment of FIGS. 1 to 21, although the manner of achieving that may vary to suit the different nature of the barrel assembly 101. In the arrangement shown in FIG. 22, the barrel end cap 127 is a plate-like member located within the end portion of the tubular section 111 and held against rotation relative thereto as previously described. An opening 138 through the end cap 127 is preferably substantially complementary in shape to part 159 at the end portion 137 of the key blade 133 (FIG. 27) so that the key 106 can drive the barrel assembly 101 at both its outer and inner ends. The outer end drive is through grooves 141 at the end portion 139 of the blade 133 and cooperable ribs of the barrel assembly 101 as previously described. As the end cap 127 is positioned beneath the locking bar 173 it has a peripheral recess 186 to accept part of that bar 173 when the bar 173 is in the position shown in FIG. 24.

Figure 29:
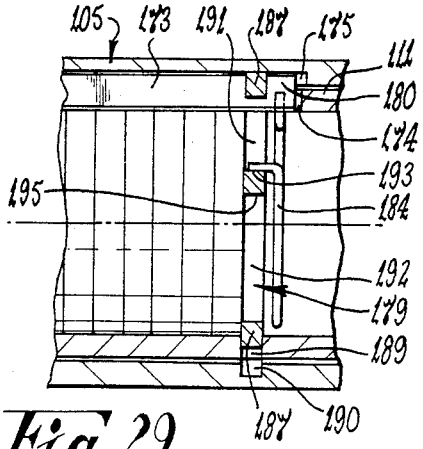
FIG. 29 is a cross sectional view taken along line XXIX—XXIX of FIG. 25.
Figure 30:
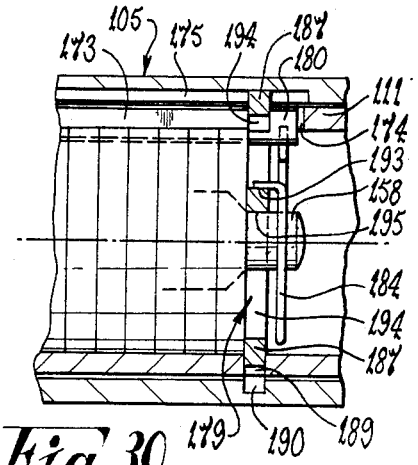
FIG. 30 is a view similar to FIG. 29 but showing the locking bar out of engagement with the lock cylinder and and a standard key inserted into the lock.
Figure 31:
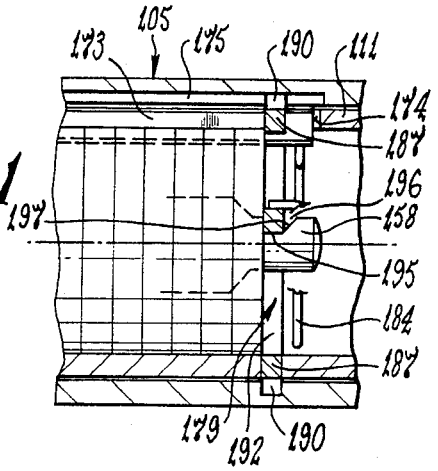
FIG. 31 is a view similar to FIG. 30 but showing a special key inserted into the lock.

In the preferred form shown in FIG. 22, the retainer plate 179 is a parallel sided member having curved end portions 187 and is slidable transverse of the barrel axis in a groove 188 extending completely across one face of the end cap 127. Slots 189 corresponding to the groove 188 are formed through the wall of the tubular section 111 and the retainer plate 179 has a length such that it can protrude beyond the periphery of the end cap 127 and through at least one of the slots 189. A circumferentially extending retainer groove 190 (FIGS. 29 to 31) in the inner surface of the cylinder 105 is in alignment with the slots 189 so as to receive one of the end portions 187 of the retainer plate 179 in the normal condition of the lock (FIG. 29) and thereby prevent axial withdrawal of the barrel assembly 101. The retainer groove 190 of the cylinder 105 preferably intersects the locking bar groove 175 as shown in FIGS. 29 to 31.

The retainer plate 179 preferably has two openings 191 and 192 as shown. The opening 191 receives the end portion 180 of the locking bar 173 and the other opening 192 permits passage of the key blade end portion 137 (FIG. 30). The biasing spring 184 preferably acts, as shown, between the underside of the bar 173 and an opposed end 193 of the opening 191 so as to urge the bar 173 towards the adjacent surface of the cylinder 105. Furthermore, the locking bar 173 has a transverse slot 194 in its upper side so as to receive part of the adjacent end portion 187 of the retainer plate 179 when the bar 173 is in the lock position as shown in FIG. 29.

When the lock is in the normal locked condition (FIG. 29) the locking bar 173 is located in the locking groove 175 and the adjacent end portion 187 of the retainer plate 179 is in the retainer groove 190 of the cylinder 105. The locking bar spring 184 tends to move the retainer plate 179 out of the groove 190 but such movement is prevented by engagement between the retainer plate 179 and the locking bar 173. When the correct key 106 is inserted into the lock, the locking bar 173 is able to move clear of the cylinder 105, but that movement of the locking bar 173 does not occur until the barrel assembly 101 is rotated in one direction or another to cam the bar 173 out of the groove 175 as shown in FIG. 30. As also shown in FIG. 30, the retainer plate 179 is prevented from following the movement of the bar 173 by engagement of an upper end 195 of the opening 192 and the surface of the blade end portion 137.

Figure 28:
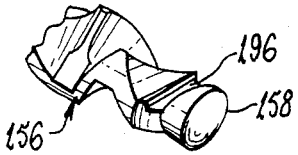
FIG. 28 is a perspective view of an end portion of the blade of a special key for use with the lock of FIG. 22.

If withdrawal of the barrel assembly 101 is required, a special key is used for that purpose. The end portion 158 of one such special key blade 156 is shown in FIG. 28 and has a transverse recess 196 to allow the retainer plate 179 to move with the locking bar 173 so as to be clear of the cylinder groove 190 (FIG. 31). The recess 196 preferably has a sloping ramp surface 197 (FIG. 31)

to lift the retainer plate 179 back to its cylinder engaging position when the special key blade 156 is being withdrawn from the lock.

In the embodiment last described, withdrawal of the key 106 from the barrel is prevented when the locking bar 104 is displaced laterally from the slot 174 because the bar 104 prevents relative rotation of the discs 102 which is necessary for such removal to occur. If desired, one or more additional slots 174 may be provided around the tubular section 111 to allow key removal at more than one rotational position of the barrel assembly 101. Master keying of the second embodiment may be achieved by providing at least one of the discs 102 with two circumferentially spaced locking bar cavities 177.

Figure 32:
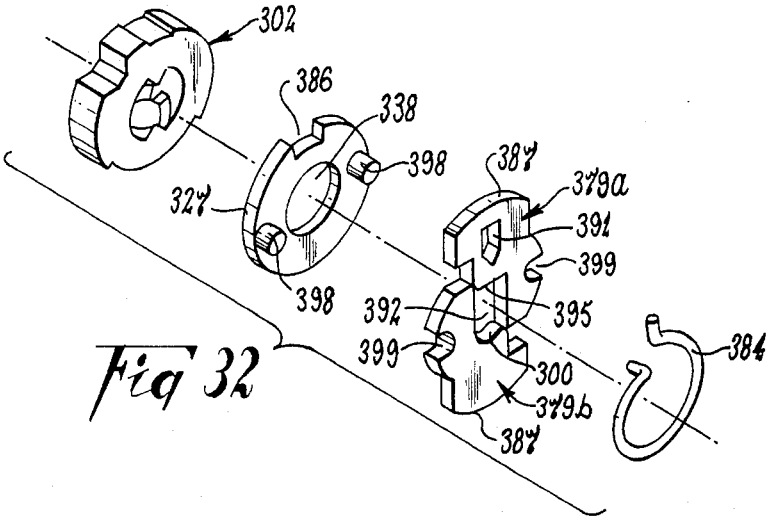
FIG. 32 is an exploded perspective view of an alternative form of barrel retaining means for the lock of FIG. 22.
Figure 33:
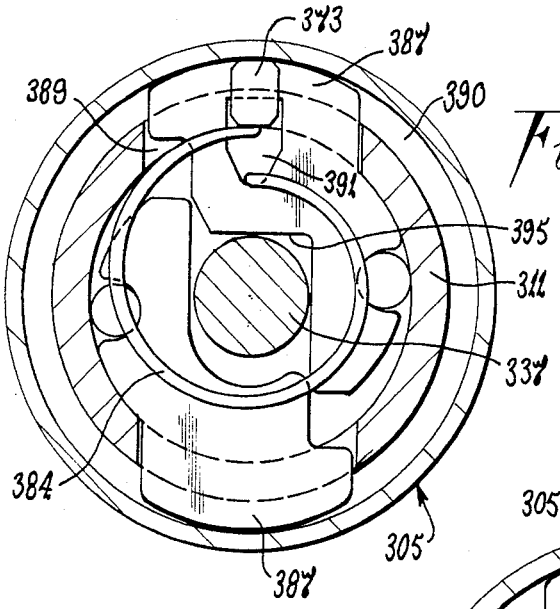
FIG. 33 is an enlarged transverse cross sectional view of the barrel assembly of FIG. 22 but showing the modified retaining means of FIG. 32 and also showing a standard key inserted into the lock.
Figure 34:
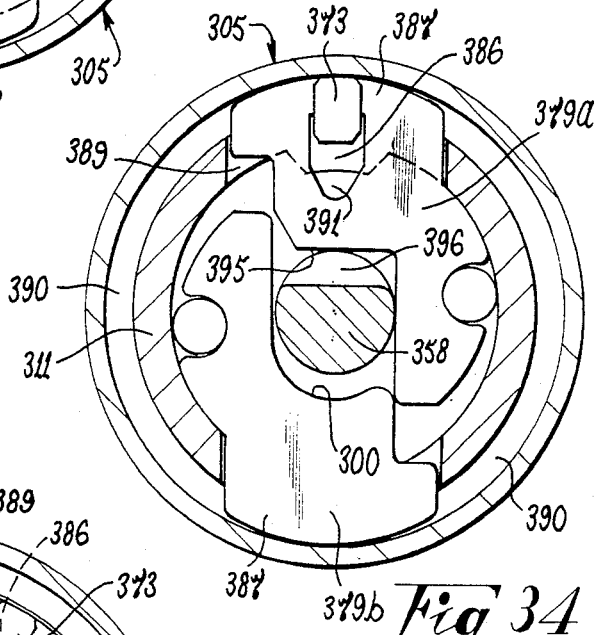
FIG. 34 is a view similar to FIG. 33 but showing a special key inserted into the lock.
Figure 35:
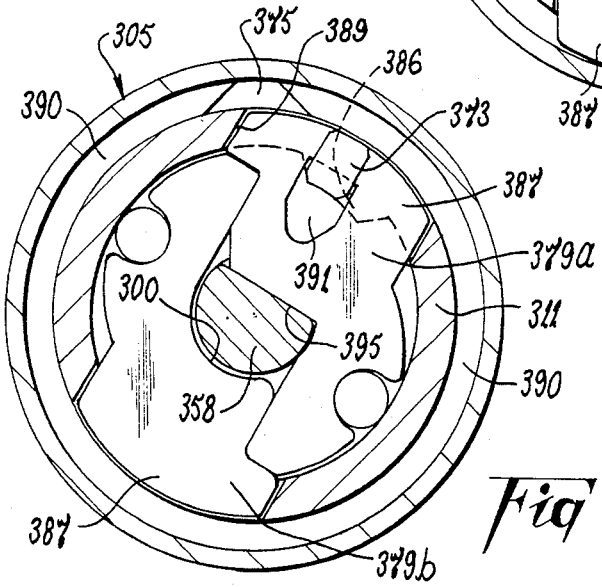
FIG. 35 is a view similar to FIG. 34 but showing the barrel assembly rotated relative to the cylinder by use of the special key.

A further modification of the last described embodiment is shown in FIG. 32 and concerns the nature of the retainer plate. In the construction according to FIG. 22 only one end portion 187 of the plate 179 locates within the circumferential groove 190 to prevent withdrawal of the barrel assembly 101 from the cylinder 105. In the FIG. 32 construction, the retainer plate is formed of two parts 379*a* and 379*b*, each of which has a respective curved end portion 387. A drive plate 327 is substituted for the end cap plate 127 of the previous embodiment and has two drive pins 398 each of which locates within a cooperable recess or hole 399 of a respective one of the plate parts 379*a* and 379*b*. The drive plate 327 rotates with the barrel assembly because of engagement within the slots 389 of the tubular section 311 as shown in FIGS. 33 to 35. A peripheral recess 386 is provided in the drive plate 327 to provide passage for the bar 373 and that recess 386 is sufficiently wide to allow some degree of relative rotation between the plate 327 and the remainder of the barrel assembly (FIGS. 34 and 35).

In the normal locked condition as shown in FIG. 33, the plate parts 379*a* and 379*b* are held apart by the drive plate 327 such that both end portions 387 engage within the retaining groove 390 of the cylinder 305. Thus, there is greater resistence to forced separation of the barrel assembly and cylinder. When the standard key is inserted into the lock, the end portion 337 of that key prevents radial inward movement of the plate part 379*a* by engaging with the edge surface 395 of the opening 392 which is defined between the two parts 379*a* and 379*b* (FIG. 33). When the special key is used however, as shown in FIG. 34, the transverse recess 396 in the end portion 358 of that key provides room for the plate part 379*a* to move radially inwards. Clearance is provided between the edge surface 300 of the plate part 379*b* and the end portion 358 of the key blade so as to permit corresponding inward movement of the part 379*b*. Thus, rotation of the plate 327 relative to the remainder of the barrel assembly as permitted by the recess 386, moves both parts 379*a* and 379*b* inwards to the position shown in FIG. 35 and that rotation may be initiated by the spring 384 or by turning movement of the key.

Figure 36:
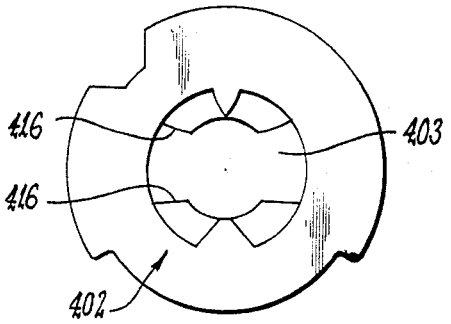
FIG. 36 is an end view of a modified form of disc usable with the lock of FIG. 22.
Figure 37:
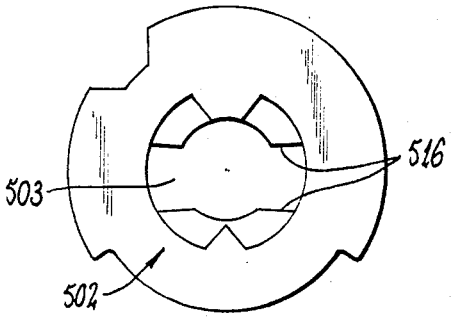
FIG. 37 is a view similar to FIG. 36 but showing yet another modified form of disc.
Figure 38:
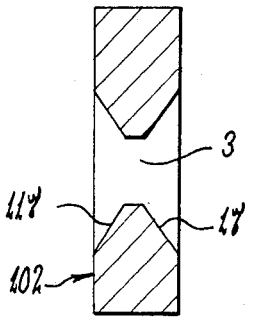
FIG. 38 is a diagrammatic cross sectional view of a disc of the kind shown in FIG. 22.
Figure 39:
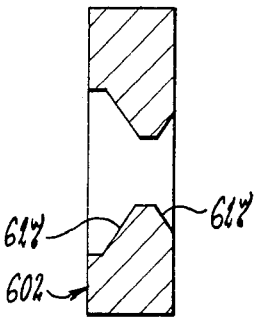
FIG. 39 is a view similar to FIG. 38 but showing a modified form of disc.
Figure 40:
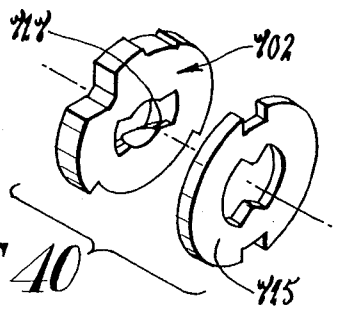
FIG. 40 is a perspective view of yet another modified form of disc for use with the lock of FIG. 22.

The barrel discs can be varied substantially from the forms previously shown and described. For example, as shown in FIG. 36, the opposite side surfaces 416 of the disc opening 403 may have a different curvature. In FIG. 37 on the other hand, the respective side surfaces 516 are spaced a different distance from the axis of the disc 502. FIG. 38 shows the camming faces 117 of the disc 102 previously described as being symmetrical about the disc axis, whereas an alternative assymmetrical relationship is shown in FIG. 39. Furthermore, FIG. 40 shows a disc 702 having camming faces 717 on a front side only and in that event it is generally preferred to have a spacer 715 located between adjacent discs 702. Many other variations are clearly available.

In the embodiments previously described the discs are arranged for free rotation relative to one another within the limits permitted by the total barrel assembly. It is possible however, to employ biasing means so as to normally locate each disc at a key receiving position which can be selected to suit requirements. Such biasing may be effected by spring means, magnetic means, or any other suitable means.

Figure 41:
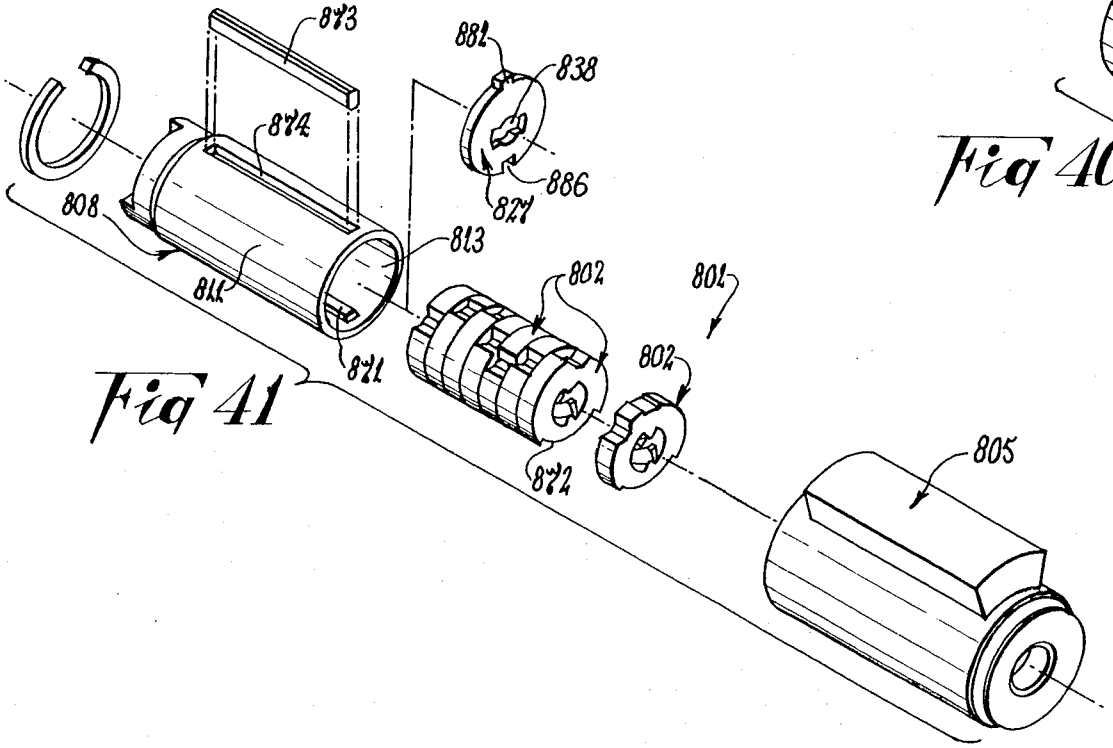
FIG. 41 is an exploded perspective view of yet another embodiment of the invention.

Although the embodiments described have included provision for removing the barrel assembly from the lock cylinder, the basic concepts of the invention are applicable to locks not having that facility. One such lock is shown in FIG. 41 and that is similar in many respects to the lock of FIG. 22. The barrel assembly 801 is held against rotation relative to the cylinder 805 by a side locking bar 873 as previously described. There is no releasable retainer for the barrel assembly 801 however, and an end plate 827 is non-rotatably located within the bore 873 of the tubular section 811. A lug 881 of the plate 827 locates within the locking bar slot 874 and a recess 886 of the plate 827 locates over a rib 871 of the tubular section 811 to hold the plate 827 against relative rotation. The terminal end portion of the key non-rotatably engages within the opening 838 of plate 827 to drive the barrel assembly 801. The rib 871 also engages within the recess 872 of the discs 802 to limit relative rotation of the discs 802. Such a lock can be made of relatively small dimensions.

The key is also open to substantial variation from the constructions particularly described. For example, the cross sectional shape and/or size of the key blade can vary along its length rather than being substantially constant (at least at the locating portions) as previously described. If the shape and/or size does vary however, the variation must be such that the blade can nevertheless pass through all disc openings constituting the keyway and that will generally require a reduction in size towards the outer terminal end of the key blade.

A lock according to the present invention has several important advantages. One particular advantage is the complex nature of the key and consequently the immense difficulty of duplicating such a key. That characteristic substantially improves the security of the system embodying such a lock. There is the further advantage that the lock is extremely difficult to pick. Another advantage is the convenient nature of the combination changing exercise if the facility for barrel removal is adopted. That is, the change in combination can be achieved quite simply by use of a special key and no other tool. Still further, the lock is not restricted to one hand of operation, but the barrel assembly can be rotated in either direction.

It is to be understood that various alterations, modifications and/or additions may be introduced into the constructions and arrangements of parts previously described without departing from the spirit or ambit of the invention as defined by the appended claims.

Having now described our invention what we claim as new and desire to secure by Letters Patent is:

1. A key operated cylinder lock including a housing having a cylindrical bore therein, a barrel assembly rotatably mounted within said bore, a plurality of individual discs forming part of said barrel assembly and being arranged for relative rotation about a common axis, a key receiving opening of non-circular shape formed through each said disc at a location such that said common axis passes therethrough, locking means operative to prevent rotation of said barrel assembly relative to said housing and being responsive to the rotational positioning of the discs so as to be rendered inoperative when each said disc has a particular rotational position relative to the adjacent said disc, and at least one camming face is provided at a front side of each said disc at each of two opposite sides of said common axis, said camming faces being arranged for coaction with a key inserted into said lock and each being located directly adjacent the respective disc opening and sloping rearwardly of the said disc towards that opening so that said coaction induces the respective said disc to rotate towards a position at which said key can be moved longitudinally through the opening thereof.

2. A lock according to claim 1, wherein said common axis is substantially coincident with the axis of rotation of said barrel assembly.

3. A key operated cylinder lock including a housing having a cylindrical bore therein, a barrel assembly rotatably mounted within said bore, a plurality of individual discs forming part of said barrel assembly and being arranged for relative rotation about a common axis, a key receiving opening of non-circular shape formed through each said disc at a location such that said common axis passes therethrough, locking means operative to prevent rotation of said barrel assembly relative to said housing and being responsive to the rotational positioning of the discs so as to be rendered inoperative when each said disc has a particular rotational position relative to the adjacent said disc, and at least one camming face is provided at a front side of each said disc, said camming faces being arranged for coaction with a key inserted into said lock and each being located directly adjacent the respective disc opening and sloping rearwardly of the said disc towards that opening so that said coaction induces the respective said disc to rotate towards a position at which said key can be moved longitudinally through the opening thereof, at least one said camming face being provided at the rear side of each said disc and being arranged to slope in the opposite direction to the front side camming face, the rear side camming face being adapted to coact with said key as it is moved longitudinally out of said lock so as to induce rotation of the respective said disc.

4. A key operated cylinder lock including a housing having a cylindrical bore therein, a barrel assembly rotatably mounted within said bore, a plurality of individual discs forming part of said barrel assembly and being arranged for relative rotation about a common axis, a key receiving opening of non-circular shape formed through each said disc at a location such that said common axis passes therethrough, locking means operative to prevent rotation of said barrel assembly relative to said housing and being responsive to the rotational positioning of the discs so as to be rendered inoperative when each said disc has a particular rotational position relative to the adjacent said disc, said locking means comprising a plunger mounted in said housing for movement towards and away from said barrel assembly, spring means urging said plunger towards said barrel assembly, and a locking recess within said barrel assembly which receives an end portion of said plunger when said locking means is in its operative condition.

5. A lock according to claim 4, wherein actuator means is operative to move said plunger out of said operative condition to free said barrel assembly for rotation relative to said housing, and said actuator means is responsive to the relative location of said discs so as to be operative when each said disc is in said particular rotational position.

6. A lock according to claim 5, wherein said actuator means includes a series of balls, each said disc has a hole therethrough at a location radially outwards of the respective said opening, one of said balls is located in each said hole, and said balls are aligned and in mutual engagement when each said disc is in said particular rotational position so as to form a rigid assembly which influences the position of said plunger.

7. A key operated cylinder lock including a housing having a cylindrical bore therein, a barrel assembly rotatably mounted within said bore, a plurality of individual discs forming part of said barrel assembly and being arranged for relative rotation about a common axis, a key receiving opening of non-circular shape formed through each said disc at a location such that said common axis passes therethrough, locking means operative to prevent rotation of said barrel assembly relative to said housing and being responsive to the rotational positioning of the discs so as to be rendered inoperative when each said disc has a particular rotational position relative to the adjacent said disc, releasable means being provided to hold said barrel assembly against axial separation from said housing while permitting said relative rotation thereof, and said releasable means being responsive to insertion of a special key into said lock to release said barrel assembly for axial separation from said housing.

8. A lock according to claim 7, wherein said releasable means includes two co-operable parts of said barrel assembly, coupling means acts between said parts and is operative to prevent said axial separation, said coupling means being rendered inoperative by relative rotation between said parts, and one said part being responsive to insertion of said special key into said lock whereby rotation of said barrel assembly by said special key causes said relative rotation of the said parts.

9. A lock according to claim 8, wherein said two parts rotate together relative to said housing with the remainder of said barrel assembly when a standard key is used to operate said lock.

10. A lock according to claim 9, wherein said one part is removable from said housing with said remainder of the barrel assembly when said special key is used, and the other said part remains within said housing during that removal.

11. A lock according to claim 7, wherein said releasable means includes a retaining plate which is mounted on said barrel assembly for rotation therewith and for radial movement relative thereto, a circular groove provided in the surface of said cylindrical bore, an edge portion of said plate which locates within said groove to prevent said axial separation but to permit rotation of said barrel assembly relative to said housing, spring means acting on said plate to move it radially of said barrel and out of engagement with said groove, and blocking means normally operative to prevent movement of said plate out of said groove.

12. A lock according to claim 11, wherein said locking means constitutes said blocking means and retains said retaining plate against movement out of said groove while in said operative position.

13. A lock according to claim 11, wherein said blocking means remains operative only while said locking means is operative, a standard said key usable with said lock has an end portion which coacts with said retaining plate to hold it against movement out of said groove when said locking means is inoperative, and said special key has an end portion which permits said retaining plate to move out of said groove when said locking means is inoperative.

14. A lock according to claim 11, wherein there are two said retaining plates, each of which has a respective said edge portion locating within said groove at respective opposite sides of said barrel assembly to prevent said axial separation of the barrel assembly, said spring acts on one of said retaining plates, and a rotatable drive plate interconnects said retaining plates so that each responds to radial movement of the other.

15. A key usable with a cylinder lock having a plurality of rotatable locking elements and including, an elongate blade adapted for insertion into a keyway of said lock, a plurality of locating portions provided along said blade and being spaced apart in the longitudinal direction thereof, the cross-sectional shape of said blade at each said locating portion being non-circular and having a major axis which extends transverse to and substantially intersects the longitudinal axis of said blade, each said major axis being angularly displaced about said longitudinal axis relative to at least one other said major axis, at least one indexing surface at each said locating portion which determines the rotational position of a said locking element engaged thereby when said blade is fully inserted into said keyway, and at least one camming surface extending between adjacent said locating portions and being arranged to cause partial rotation of an engaged said locking element as said blade is moved longitudinally through said keyway.

16. A key according to claim 15, wherein at least one said camming surface is provided between at least the majority of the adjacent said locating portions and each said camming surface slopes from one said indexing surface to another said indexing surface.

17. A key according to claim 15, wherein the maximum said angular displacement between any two said major axes is not substantially greater than 55°.

18. A key according to claim 15, wherein adjacent camming surfaces on respective opposite sides of at least one of said indexing surfaces slope in opposite directions away from that indexing surface.

19. A key according to claim 15, wherein the said longitudinal spacing of said locating portions is substantially constant.

20. A key according to claim 19, wherein each said camming surface slopes at substantially the same angle relative to said longitudinal axis, and the direction of said slope is different for at least two of said camming surfaces.

21. A key according to claim 19, wherein each said camming surface slopes at an angle relative to said longitudinal axis and the angle of slope of at least one said camming surface is different to that of at least another sloping camming surface.

22. A key according to claim 15, wherein each said indexing surface has a width in the longitudinal direction of said plate and the average said width of at least one said indexing surface is different to that of another said indexing surface.

23. A key according to claim 15, wherein the angular disposition of said major axes imparts a twisted configuration to said blade, and the hand of said twist is reversed at a plurality of locations along the length of said blade.

24. A key according to claim 23, wherein each said location at which the hand of twist reverses corresponds to a said locating portion.

25. A key according to claim 23, wherein the cross sectional shape of said blade is substantially rectangular at each said locating portion and at any position between any two adjacent said locating portions, two said indexing surfaces are provided at each said locating portion on respective opposite sides of said longitudinal axis and each extends generally in the direction of the respective said major axis, and the cross sectional width of said blade at each said locating portion is substantially greater in the direction of the respective said major axis than transverse thereto.

26. A key according to claim 15, wherein said blade is of substantially the same cross sectional shape and size at each said locating portion.

27. A key according to claim 15 usable with a cylinder lock having a plurality of rotatable locking elements and including, an elongate blade adapted for insertion into a keyway of said lock, a plurality of locating portions provided along said blade and being spaced apart in the axial direction thereof, the cross sectional shape of said blade at each said locating portion being substantially rectangular and having a major axis which extends transverse to and intersects the longitudinal axis of said blade, each said major axis being angularly displaced about said longitudinal axis relative to at least one other said major axis, at least one indexing surface at each said locating portion which is operative to engage a respective said locking element to determine the rotational position thereof when said blade is fully inserted into said keyway, each said indexing surface extending generally in the direction of the respective said major axis, and at least one camming surface extending between each two adjacent said locating portions and sloping relative to said longitudinal axis so as to cause partial rotation of an engaged said locking element as said blade is moved longitudinally through said keyway, said angular disposition of said major axes imparting a twisted configuration to said blade and the hand of said twist is reversed at least at one location along the length of said blade.

28. A lock and key combination comprising a key according to claim 15 and a lock including a housing having a cylindrical bore therein, a barrel assembly having a substantially cylindrical body part mounted within said bore for rotation relative to said housing and a plurality of individual discs contained within said body part, said discs being arranged for relative rotation about the axis of rotation of said body part, an opening of non-circular shape formed through each said disc at a location such that said axis of rotation passes therethrough, each said opening forming part of a keyway which receives said key blade and having part of its periphery co-operable with a respective said indexing surface of said blade to locate the respective said disc at a particular rotational position relative to adjacent said discs when said blade is fully inserted into said keyway, locking means operative to prevent rotation of said body part relative to said housing and being rendered inoperative in response to each said disc adopting its said particular rotational position, and co-operable drive means acting between said key and said body part to prevent relative rotation between said key blade and said body part when said blade is fully inserted into said keyway.

29. A combination according to claim 28, wherein at the fully inserted position of said key blade, each said disc is prevented from substantial rotation relative to said key blade by co-operative engagement between the periphery of the respective said opening and the respective said locating portion of the key blade.

30. A combination according to claim 28, wherein each said disc is biased to adapt a key receiving position of rotation when said key blade is not within said keyway, and said key receiving position is different to said particular rotational position for at least one of said discs.

31. A combination according to claim 28, wherein at least one sloping camming face is provided on a front side of each said disc, each said camming face coacting with at least one said camming surface of the key blade during insertion of said blade into said keyway so as to cause the respective said disc to rotate relative to adjacent said discs and said body part.

* * * * *